US010232208B2

(12) United States Patent
Chen

(10) Patent No.: US 10,232,208 B2
(45) Date of Patent: Mar. 19, 2019

(54) TRAMPOLINE ENCLOSURE SYSTEM

(71) Applicant: Samuel Chen, Hung Hom (CN)

(72) Inventor: Samuel Chen, Hung Hom (CN)

( * ) Notice: Subject to any disclaimer, the term of this patent is extended or adjusted under 35 U.S.C. 154(b) by 30 days.

(21) Appl. No.: 15/629,127

(22) Filed: Jun. 21, 2017

(65) Prior Publication Data

US 2018/0036570 A1 Feb. 8, 2018

Related U.S. Application Data

(63) Continuation-in-part of application No. 15/228,961, filed on Aug. 4, 2016, now abandoned.

(51) Int. Cl.

| | |
|---|---|
| ***A63B 5/11*** | (2006.01) |
| ***A63B 71/00*** | (2006.01) |
| ***A63B 71/02*** | (2006.01) |
| *A63B 21/02* | (2006.01) |

(52) U.S. Cl.

CPC ..... *A63B 5/11* (2013.01); *A63B 71/0054* (2013.01); *A63B 71/022* (2013.01); *A63B 21/023* (2013.01); *A63B 2071/009* (2013.01); *A63B 2210/50* (2013.01); *A63B 2225/62* (2013.01)

(58) Field of Classification Search

CPC ..... A63B 5/11

See application file for complete search history.

(56) References Cited

U.S. PATENT DOCUMENTS

| | | | | |
|---|---|---|---|---|
| 7,220,218 | B1 * | 5/2007 | Chu | A63B 5/11 403/170 |
| 2004/0091307 | A1 * | 5/2004 | James | F16B 7/04 403/188 |
| 2005/0143225 | A1 * | 6/2005 | Adams | A63B 5/11 482/27 |
| 2006/0189441 | A1 * | 8/2006 | VanElverdinghe | A63B 5/11 482/27 |
| 2007/0049463 | A1 * | 3/2007 | Chu | A63B 5/11 482/27 |
| 2009/0023558 | A1 * | 1/2009 | VanElverdinghe | A63B 71/022 482/29 |
| 2010/0075810 | A1 * | 3/2010 | Schaffer | A63B 5/11 482/27 |
| 2010/0240496 | A1 * | 9/2010 | Chen | A63B 5/11 482/27 |

* cited by examiner

*Primary Examiner* — Nyca T Nguyen
(74) *Attorney, Agent, or Firm* — Clement Cheng

(57) ABSTRACT

A trampoline comprising a trampoline frame having legs. The trampoline frame has a trampoline frame horizontal portion. A trampoline bed is suspended across the trampoline frame horizontal portion. Springs extend between the trampoline frame and trampoline bed. An enclosure is connected to the trampoline frame. The enclosure has an enclosure upper support. The enclosure supports an enclosure net. A pad system covers the springs. The pad system includes a wall pad extending upwardly from the springs and terminating at a pad system apex. The pad system further includes a buttress pad connected to the pad system apex at an apex angle from the wall pad, which is defined as an angle between a wall pad outside surface and the buttress pad. The buttress pad extends downwardly to cover at least partially the trampoline frame horizontal portion.

14 Claims, 8 Drawing Sheets

TRAMPOLINE ENCLOSURE SYSTEM

This application claims priority from and is a continuation in part of U.S. utility patent application Ser. No. 15/285,800, by inventor Samuel Chen, entitled Trampoline Enclosure and Pad System, filed Oct. 5, 2016, the disclosure which is incorporated herein by reference.

This application claims priority from and is a continuation in part of U.S. patent application Ser. No. 15/228,961 for a Trampoline Enclosure And Pad System filed on Aug. 4, 2016, by inventor Samuel Chen, the disclosure of which is incorporated herein by reference.

FIELD OF THE INVENTION

The present invention is in the field of trampoline enclosure and pad systems.

DISCUSSION OF RELATED ART

Trampoline enclosures and trampoline spring covers have become more prevalent recently. Trampoline spring covers have been made as pads or sheets to cover the trampoline springs. Trampoline enclosures often include netting.

A variety of different trampoline enclosure and pad systems are described in United States patents. For example, Sidlinger in U.S. Pat. No. 3,767,009, issued Oct. 23, 1973, provides for a trampoline spring cover entitled Trampoline Support And Cushioning Means, the disclosure of which is incorporated herein by reference. Inventor Steger in U.S. Pat. No. 6,193,632 provides for a trampoline pad assembly having variable thickness, issued Feb. 27, 2001, entitled Trampoline Pad Assembly, the disclosure of which is incorporated herein by reference. Inventor Gift in U.S. Pat. No. 6,017,292, entitled Method And Apparatus For Attaching A Trampoline Pad, issued Apr. 7, 1998, provides for a method for attaching a pad to a trampoline frame using a tab.

Other trampoline pad systems allowed a different configuration of the pad and spring structure. Inventor Green in U.S. Pat. No. 3,677,368 issued Jul. 18, 1972, entitled Trampoline, provides for a trampoline frame that has a spring suspended construction. A user landing on a trampoline pad attached to the trampoline frame with the spring suspended construction would benefit from the downward yielding movement over a portion of the frame in response to the exertion of a downward impact. Inventor Samuel Chen in U.S. Pat. No. 7,494,144 issued Feb. 24, 2009 entitled Adjustable Trampoline Pad System provides for a trampoline pad system that can be reconfigurable in a modular fashion. While the traditional foam block has been moderately successful, it can still be improved by changing the configuration.

U.S. Pat. No. 6,261,207, entitled Trampoline or the Like with Enclosure and published Jul. 17, 2001, by inventor Publicover, describes a trampoline with a surrounding fence extending above the rebounding surface. The fence is supported by a system of vertical, resilient, independent poles, linked at their tops by a flexible strap. The poles absorb any impact along said fence by flexing inwardly when the fence is impacted, the disclosure of which is incorporated herein by reference.

U.S. patent publication 20140228176, entitled Trampoline and published Aug. 14, 2014, by inventor Miller describes a trampoline enclosure with vertical support rods "bowing outwards from the frame and curving upwards from the frame towards the mat." These rods support "at least one net" attached to said rods by a plurality of sleeves on the net, and into which the rods may be inserted, the disclosure of which is incorporated herein by reference.

In U.S. Pat. No. 5,399,132A, entitled Safety Enclosure for Trampoline and published Mar. 21, 1995, inventor Bailey presents an enclosure apparatus of a plurality of panel assemblies surrounding a trampoline bed. Each panel assembly consists of two vertical members and a horizontal member connecting said two vertical members at their top ends. A plurality of vertical and horizontal ropes attached to each panel assembly criss-cross the plane created by the vertical and horizontal members, thus providing a barrier that prevents the user from falling off the trampoline, the disclosure of which is incorporated herein by reference.

Inventor Colling describes deflective netting coupled to U-shaped pole structures and attached to a trampoline's rebounding mat in U.S. Pat. No. 7,481,740, entitled Trampoline Accessories and published Jan. 27, 2009. The netting is attached to the pole structures, which encircle the periphery of the trampoline, by tying, adhesives, fasteners, threading the poles through openings in the flexible material of the netting, or any other method of attachment known in the art, the disclosure of which is incorporated herein by reference.

U.S. Pat. No. 7,758,471, entitled Trampoline Enclosure Attachment to Trampoline Mat and published Jul. 20, 2010, by inventor Nelson, describes a method of attaching a trampoline enclosure to a trampoline frame. Buttonholes, designed to receive spring attachment features (e.g., D-ring, V-ring, etc.) are included at or near the bottom edge of an enclosure comprising of a flexible wall. When each of a trampoline bed's spring attachment features passes through a buttonhole, the enclosure securely attaches to the trampoline. The enclosure is further supported at its top end by connection to U-shaped pole structures that surround the periphery of the trampoline, the disclosure of which is incorporated herein by reference.

Inventor Chen utilizes an upper enclosure ring to suspend his enclosure net around a trampoline in U.S. Pat. No. 9,084,908, entitled Trampoline Basketball Goal and published Jul. 21, 2015. The upper enclosure ring is supported by enclosure poles that surround the trampoline bed. The upper enclosure ring is attached to the enclosure poles at or near the top ends of the enclosure poles with enclosure pole connector caps, which have grooved hook receivers to receive the enclosure ring. A sleeve at the top edge of the enclosure netting slides around the enclosure ring to suspend said netting, the disclosure of which is incorporated herein by reference.

U.S. Pat. No. 8,012,066, entitled Wire Trampoline Enclosure and published Sep. 6, 2011, by inventor Hsiang, details a trampoline enclosure including an inflexible wire ring with a plurality of connectors connected to said ring and a plurality of support poles. The support poles are bended inward at their top end. Wire slots in the support poles receive the wire ring, suspending it above the trampoline bed. An enclosure net is suspended from the wire ring at the top end of enclosure net, the disclosure of which is incorporated herein by reference.

In U.S. Pat. No. 5,941,798, entitled Safety Net for Trampolines and published Aug. 24, 1999, inventor Coan describes a trampoline net assembly which encloses a trampoline frame and is supported by multiple support members arranged in such a way that the safety net is configured in an inverted frusto configuration. Furthermore, the bottom edge of the net is equipped with a pad that extends along the bottom edge's net tire length. In its preferred embodiment, the pad has a "tapered inner peripheral edge" (see FIG. 5), the disclosure of which is incorporated herein by reference.

Inventor Schaffer describes and illustrates a safety pad for his trampoline in U.S. Pat. No. 8,790,221, entitled Trampoline and published Jul. 29, 2014. As shown in FIG. 6, the pad covers underlying springs. The lower portion of a safety net, which surrounds the rebounding surface, is stitched to members in the form of right triangles, where one edge of each triangle is formed by the member, while another edge of each triangle at right angle to said former edge overlies the pad, the disclosure of which is incorporated herein by reference.

In U.S. Pat. No. 9,545,532, entitled Trampoline Accessory Attachment System and published Jan. 17, 2017, inventor Miller states that an edge protector pad, fitted on top of and extending over the edge of the trampoline (see FIG. 4), may be added to cover the edge of the mat and any rigid items on or near the edge of the mat. The pad eliminates any gaps between the rebounding surface and the trampoline's outer frame, thus preventing injury to the user, the disclosure of which is incorporated herein by reference.

SUMMARY OF THE INVENTION

A trampoline comprising a trampoline frame having legs. The trampoline frame has a trampoline frame horizontal portion. A trampoline bed is suspended across the trampoline frame horizontal portion. Springs extend between the trampoline frame and trampoline bed. An enclosure is connected to the trampoline frame. The enclosure has an enclosure upper support. The enclosure supports an enclosure net. A pad system covers the springs. The pad system includes a wall pad extending upwardly from the springs and terminating at a pad system apex. The pad system further includes a buttress pad connected to the pad system apex at an apex angle from the wall pad, which is defined as an angle between a wall pad outside surface and the buttress pad. The buttress pad extends downwardly to cover at least partially the trampoline frame horizontal portion.

A spring cover extends between the buttress pad and the wall pad. A pad system hollow is formed between the buttress pad and the wall pad and the spring cover. The spring cover is optional and optionally formed as a padded spring cover or as a sheet spring cover. The enclosure net is preferably double layered with an outside enclosure net parallel to an inside enclosure net. The outside enclosure net and the inside enclosure net have a different weave structure, such as if the outside enclosure net has larger net openings than the inside enclosure net. The inside enclosure net preferably has net openings that are less than 1 cm and the outside enclosure net has net openings that are greater than 1 cm. The apex angle is an acute angle that is preferably less than 60°.

Figure 1:
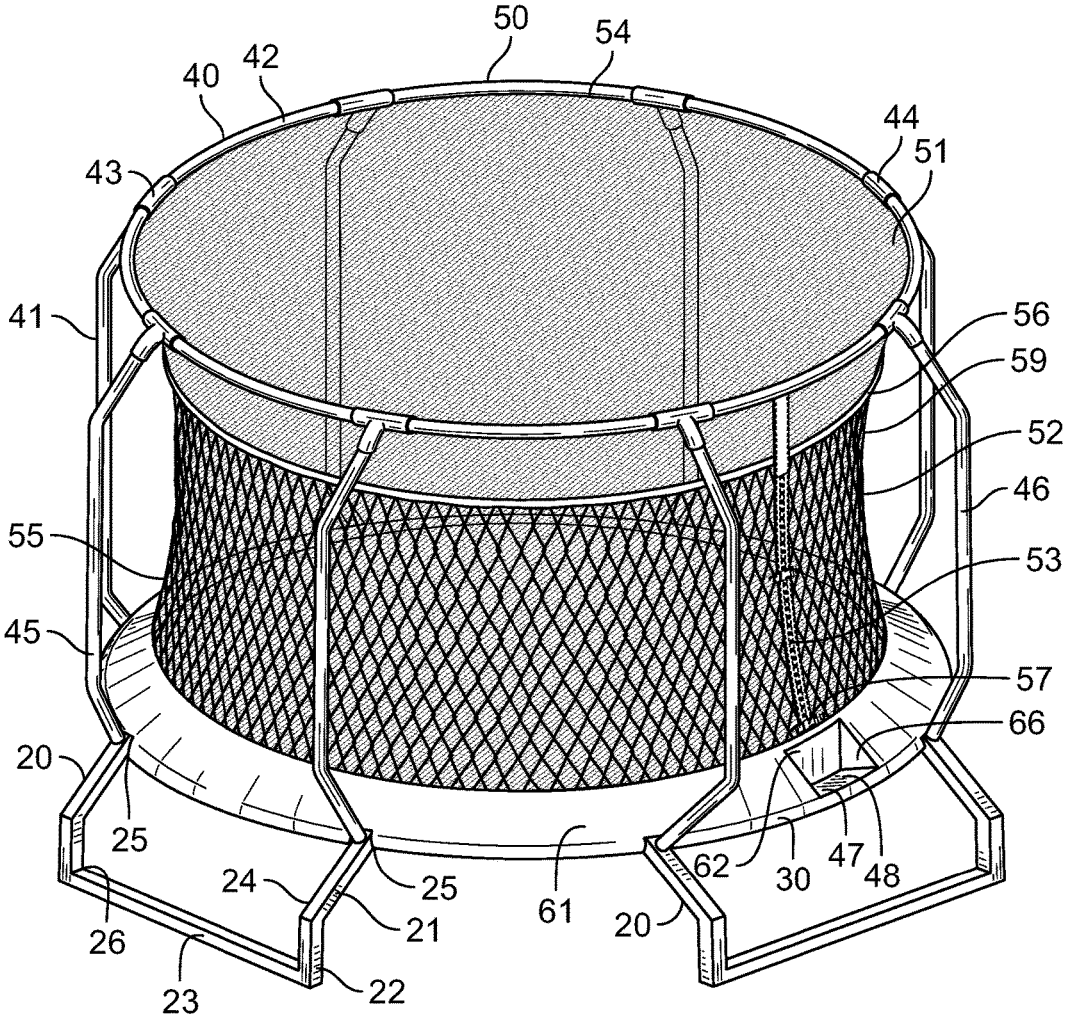
FIG. 1 is a perspective view of trampoline with a trampoline enclosure.
Figure 2:
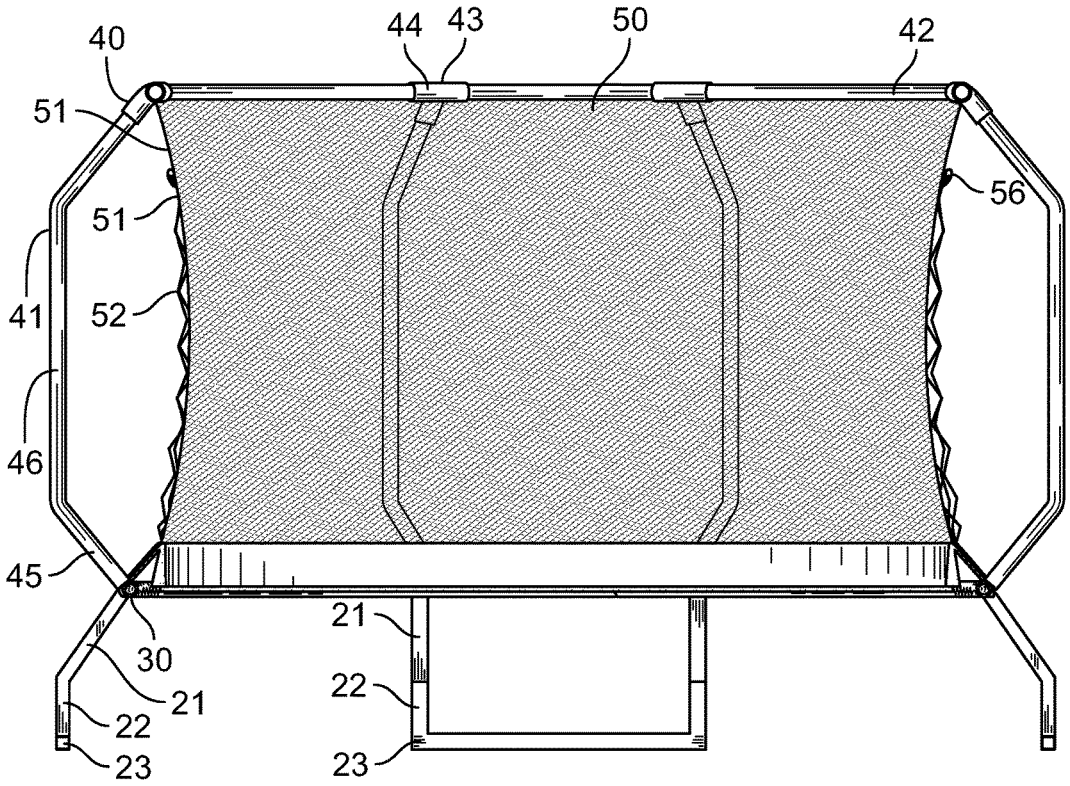
FIG. 2 is a side section view of a trampoline with a trampoline enclosure.
Figure 3:
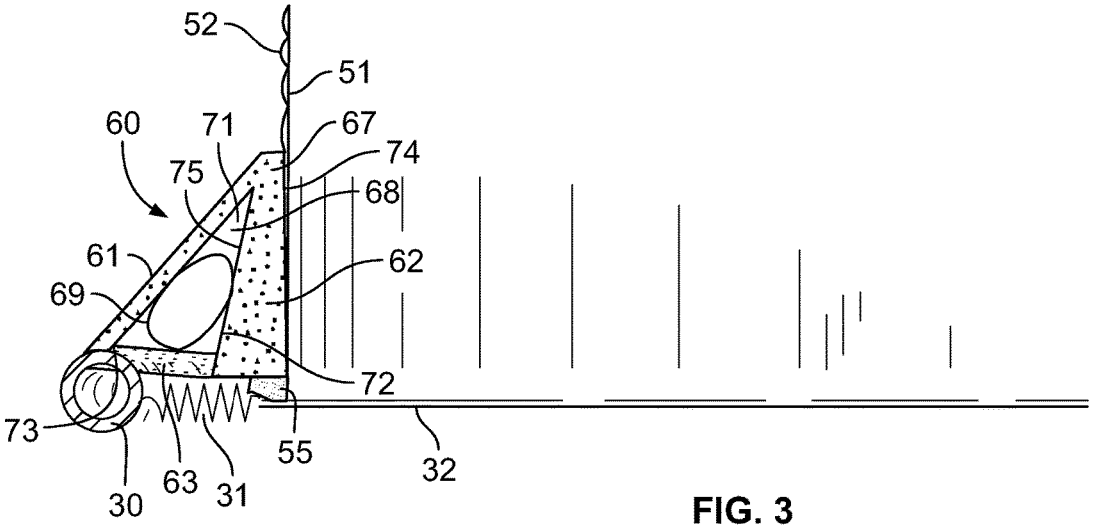
FIG. 3 is a cross section view of the trampoline pad system showing a padded spring cover.
Figure 4:
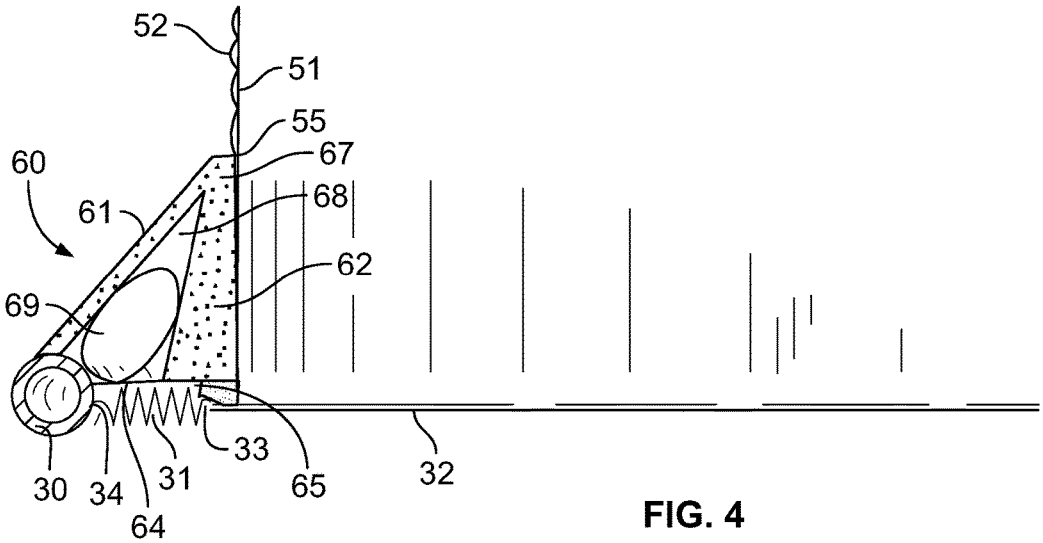
FIG. 4 is a cross section view of the trampoline pad system showing a spring cover pad that is a thin sheet.
Figure 5:
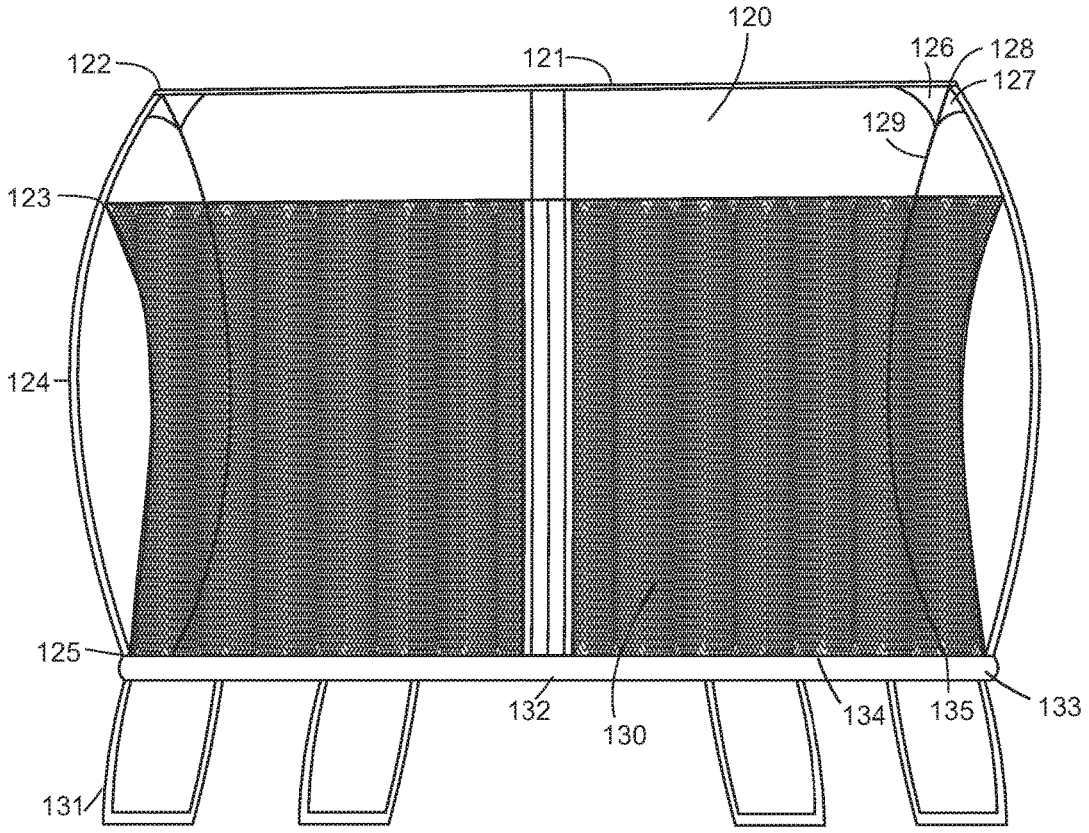
FIG. 5 is a side view of the trampoline with double netting enclosure where the outside net is connected to the outside periphery of the spring cover.
Figure 6:
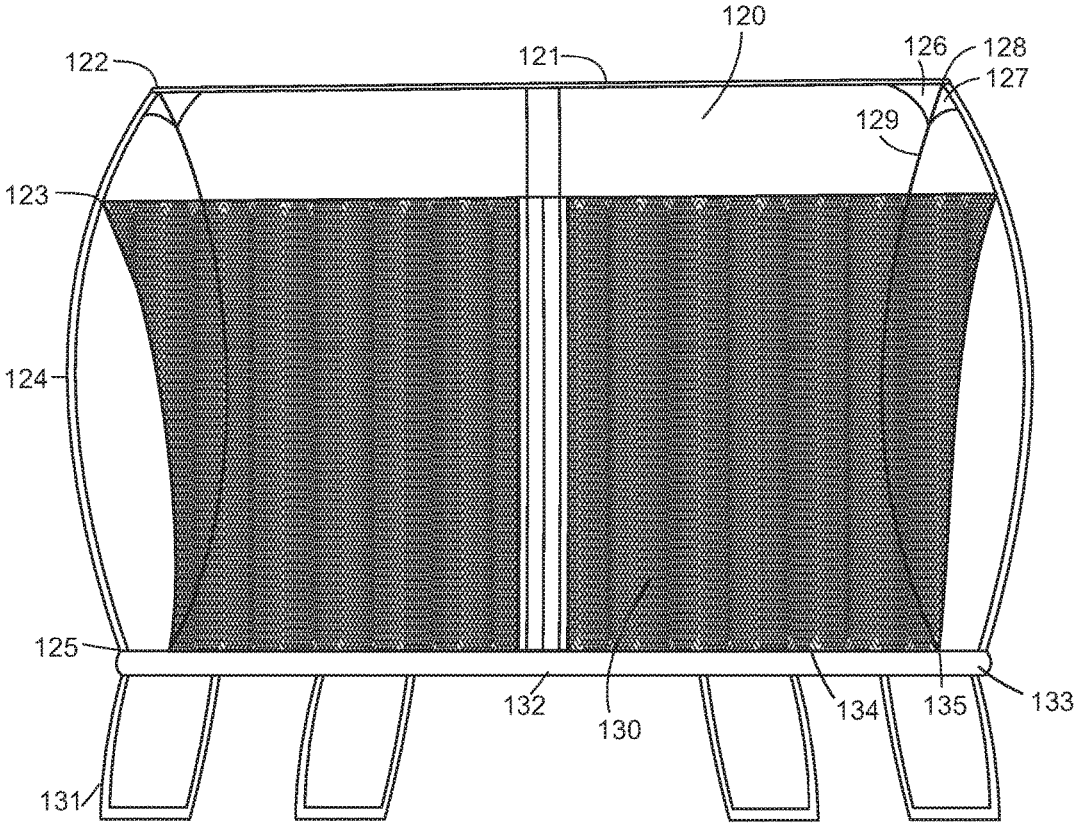
FIG. 6 is a side view of the trampoline with double netting enclosure where the outside net is connected to the inside periphery of the spring cover.
Figure 7:
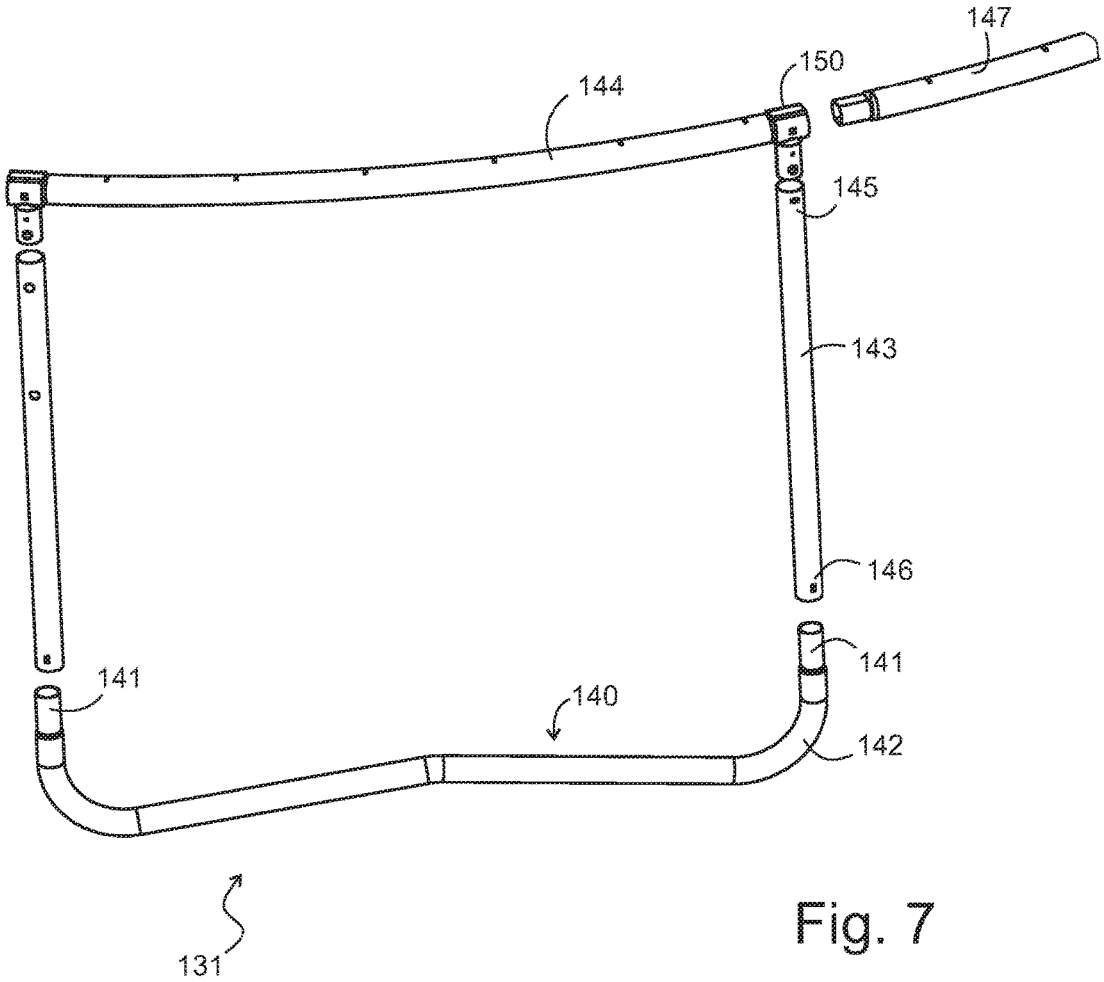
FIG. 7 is an exploded perspective view of a leg section.
Figure 8:
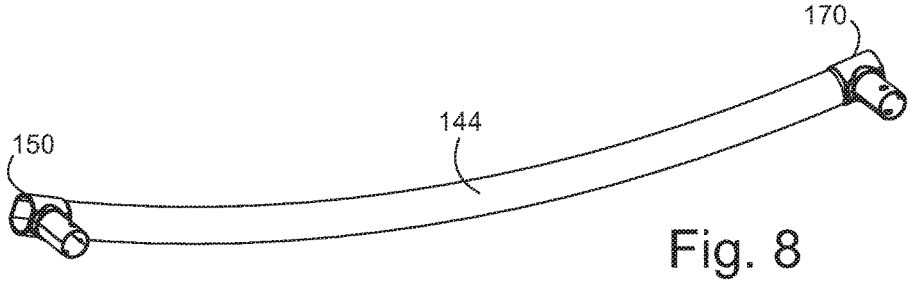
FIG. 8 is a bottom left perspective view of the horizontal leg portion.
Figure 9:
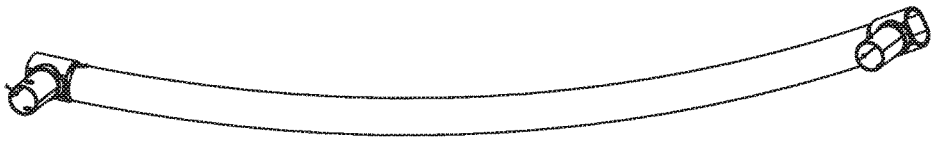
FIG. 9 is a bottom right perspective view of the horizontal leg portion.
Figure 10:
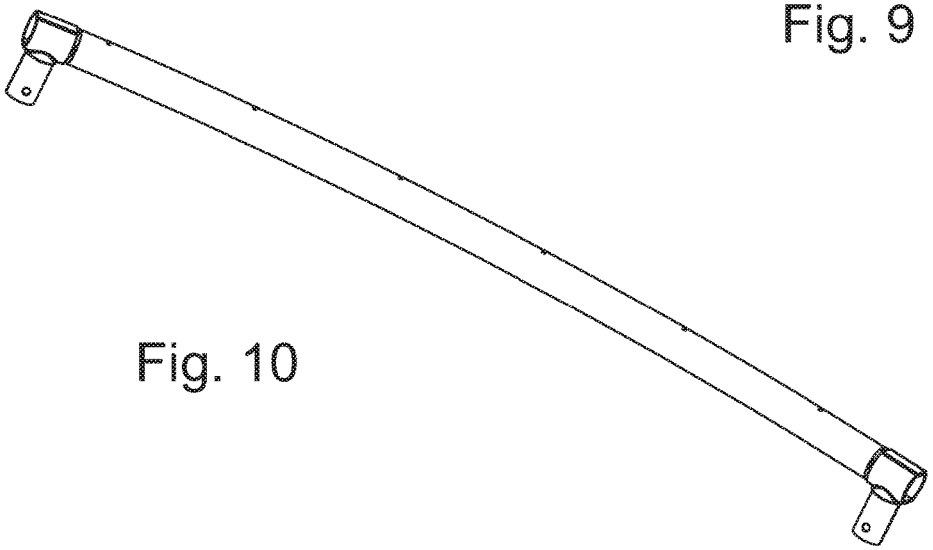
FIG. 10 is a back view of the horizontal leg portion.
Figure 11:
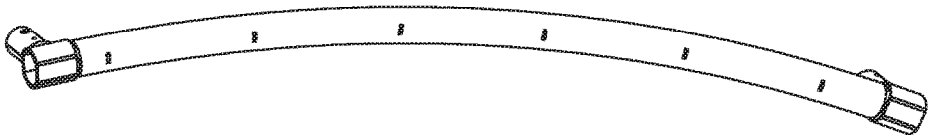
FIG. 11 is a top perspective view of the horizontal leg portion.
Figure 12:
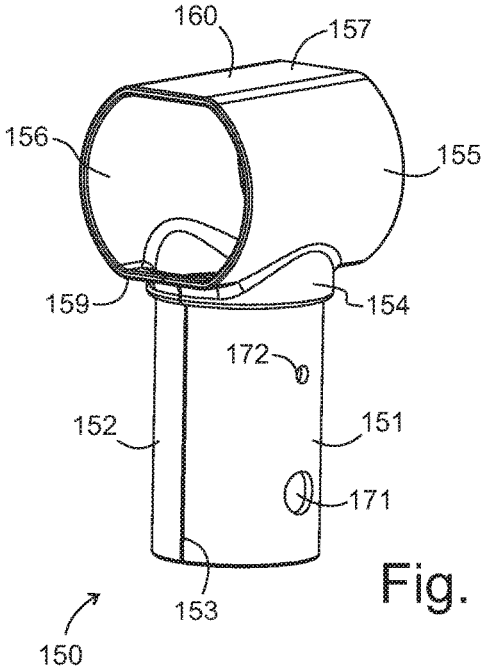
FIG. 12 is a perspective view of the frame strap.
Figure 13:
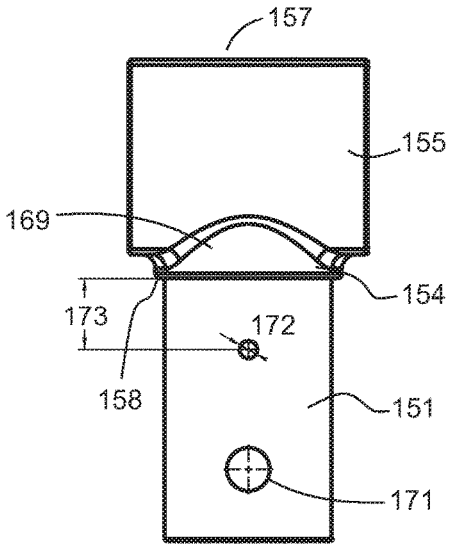
FIG. 13 is a front view of the frame strap.
Figure 14:
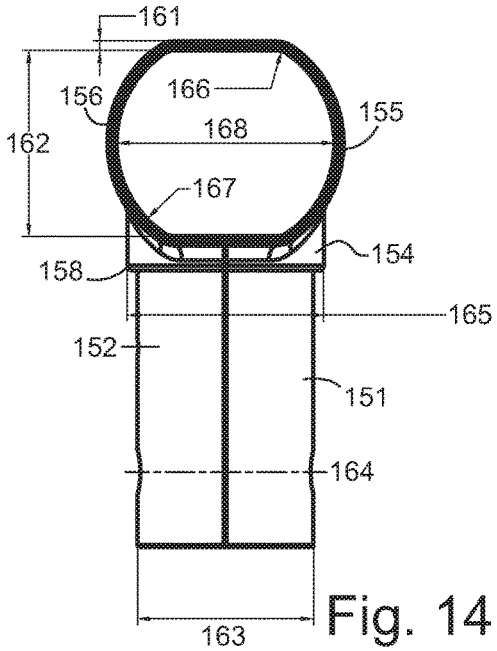
FIG. 14 is a side view of the frame strap.

The following call out list of elements can be a useful guide in referencing the element numbers of the drawings.

20 Trampoline Leg
21 Leg Angled Portion
22 Leg Vertical Portion
23 Leg Horizontal Portion
25 Leg Frame Connection
26 Leg Base Connection
30 Trampoline Frame Horizontal Portion
31 Spring
32 Bed
33 Spring Inside Connection
34 Spring Outside Connection
40 Enclosure
41 Enclosure Pole
42 Enclosure Upper Support
43 Enclosure Upper Connector
44 Enclosure Connector Receiver
45 Enclosure Pole Lower Connector
46 Pole Vertical Section
47 Indent
48 Step
50 Enclosure Net
51 Inside Enclosure Net
52 Outside Enclosure Net
53 Zipper
54 Enclosure Net Upper Connection
56 Net To Net Interface
57 Buckle
58 Zipper Lead Strip
59 Net Openings
60 Pad System
61 Buttress Pad
62 Wall Pad
63 Padded Spring Cover
64 Sheet Spring Cover
65 Pad System Spring Indent
66 Step Side Pad
67 Pad System Apex
68 Pad System Hollow
69 Inflatable Torus
71 Apex Angle
72 Inside Angle
73 Outside Angle
74 Wall Pad Inside Surface
75 Wall Pad Outside Surface
120 Inside Net
121 Enclosure Top Support
122 Enclosure Pole Upper Connection
123 Enclosure Pole Outside Net Upper Connection
124 Enclosure Pole
125 Enclosure Pole Lower Connection
126 Inside Net Top Webbing Panel

127 Enclosure Pole Top Webbing Panel
128 Inside Net Upper Connection
129 Inside Net Profile
130 Outside Net
131 Frame Leg
132 Bed
133 Spring Cover
134 Inside Net To Bed Connection
135 Outside Net To Bed Connection
140 Lower Leg Base
141 Lower Leg Base Connector
142 Upwardly Turned Ends
143 Vertical Leg Section
144 Horizontal Leg Section
145 Vertical Leg Section Upper Socket Connector
146 Vertical Leg Section Lower Socket Connector
147 Adjacent Horizontal Leg Section
150 Leg Junction Strap
151 Front Panel
152 Rear Panel
153 Panel Gap
154 Front Shoulder Adapter
155 Front Horizontal Tube Receiver
156 Rear Horizontal Tube Receiver
157 Top Flat Area
158 Shoulder
159 Rear Shoulder Adapter
160 Top Plate
161 Top Plate Thickness
162 Horizontal Tube Receiver Socket Width
163 Inside Shoulder Width
164 Through Bolt Axis
165 Outside Shoulder Width
166 Socket Inside Upper Radius
167 Socket Inside Lower Radius
168 Horizontal Tube Receiver Socket Width
169 Shoulder Adapter Profile
170 Adjacent Leg Junction Strap
171 Leg Junction Strap Connector Bolt Opening
172 Leg Junction Strap Connector Screw Opening
173 Screw Opening Shoulder Distance

DETAILED DESCRIPTION OF THE PREFERRED EMBODIMENT

Generally, the trampoline has a trampoline bed 32 suspended on springs 31. Springs 31 attach between the trampoline frame horizontal portion 30 and the trampoline bed 32. The spring inside connection 33 connects the spring 31 to the trampoline bed 32. The spring outside connection 34 connects the spring 31 to the trampoline frame horizontal portion 30. The spring outside connection and the spring inside connection can be formed as hooks formed on both ends of the spring 31. The hook ends can extend into the trampoline frame hollow portion 30, which can be formed as a tube.

The trampoline leg 20 can be formed as a continuous rim, U-shaped members, or as simple vertical posts. The trampoline leg 20 shown in the drawings has a number of sections including a leg angled portion 21 extending at an angle from a leg vertical portion 22. The leg vertical portion 22 is connected to the leg horizontal portion 23 at a leg base connection 26 to define a U-shaped leg member. The trampoline leg 20 connects to the trampoline frame horizontal portion 30 at a leg frame connection 25. The trampoline leg 20 extends slightly beyond the circumferential periphery of the trampoline frame horizontal portion 30.

The enclosure 40 is connected to the trampoline frame horizontal portion 30. The enclosure 40 has an enclosure net 50 to retain users within the jumping area of the trampoline bed 32. The trampoline bed 32 has a periphery attached to the springs. The periphery of the trampoline bed is covered by a pad system 60.

The enclosure 40 includes enclosure poles 41 that connect to enclosure upper supports 42 via enclosure upper connectors 43. The enclosure upper connectors preferably have enclosure connector receivers 44 that can be formed as sockets for receiving tubular ends of the enclosure upper support 42. The enclosure pole 41 has an enclosure pole lower connector 45 that connects the enclosure pole 41 to the trampoline frame horizontal portion 30.

The enclosure net upper connection 54 connects the enclosure net 52 the enclosure upper support 42. The enclosure net upper connection 54 can be formed as a sleeve formed on the enclosure net 50. The sleeve can form a hollow long cavity that receives the enclosure net upper support. The enclosure net upper connection 54 can also be stitched to the enclosure upper support 42. The enclosure net preferably can be a double net with a larger aperture outside net and a smaller aperture inside net. The outside net can be tied to or interlaced with the inside net with fabric loops. The outside net preferably has a thicker weave and with stronger material capable of carrying greater linear tension, and the inside net preferably has a thinner weave capable of preventing finger entrapment.

Preferably, the enclosure net 50 includes an outside enclosure net 52 and an inside enclosure net 51. The outside enclosure net 52 has a different weave structure than the inside enclosure net 51. The outside enclosure net 52 is preferably connected to the inside enclosure net 51 at a net to net interface 56. The net to net interface 56 is formed as a strip that passes around the circumference of the enclosure 40. The inside enclosure net can have net openings 59 that are less than 1 cm and the outside enclosure net can have net openings 59 that are greater than 1 cm.

A zipper 53 is preferably formed through both layers, namely the outside enclosure net 52 and the inside enclosure net 51. The zipper 53 is sewn to both the outside enclosure net 52 and the inside enclosure net 51. The zipper 53 has a zipper lead strip 58. The zipper lead strip 58 is also sewn to the inside enclosure net 51 and the outside enclosure net 52. The zipper lead strip 58 can also be sewn to the net to net interface 56. The zipper 53 can be supplemented or replaced by a set of buckles 57. The buckles 57 can be placed at a bottom or lower edge of the enclosure net 50 or at a middle of the enclosure net 50.

When entering the zippered opening of the enclosure 40, a user can use a step 48. The step 48 is formed on an indent 47. The step 48 can be made of a plank or thick sheet of plastic such as high density polyethylene. It could also be made of wood or steel, but a thick plastic sheet is preferred. The step 48 when made as a plank preferably overlies the springs to allow a user a safe entry. The plank can be enclosed in a foam pad and placed inside a fabric cover.

The indent can be supported by a step side pad is six and a wall pad 62. The indent is formed between the pair of step side pads 66 which are triangular shaped side pads. The enclosure net is preferably connected to the net lower connection 55 either at the pad system apex 67 or lower near the spring inside connection 33.

The pad system 60 can be padded or just a thin sheet. The pad system 60 includes a wall pad 62 that extends upwardly from the bed 32. The wall pad 62 has a supplemental support of a buttress pad 61. The buttress pad 61 has a larger diameter than the wall pad 62 and is angled toward the wall pad 62 so that the buttress pad 61 connects to the wall pad 62 at a pad system apex 67. The pad system apex 67 joins the buttress pad 61 with the wall pad 62 to form a pad frame. The pad frame is formed of pad material which can be foam or sheeting or both in a combination such as a laminate construction. The foam is preferably covered by the sheeting. The buttress pad 61 and the wall pad 62 have a pad system hollow 68 formed between the buttress pad 61 and the wall pad 62. The pad system hollow 68 has space for receiving an inflatable torus 63 that can be formed as a bladder that can be made in sections and inserted into the pad system hollow 68. The cross-section of the pad system hollow 68 is generally triangular, and the pad system 60 also generally has a triangular cross section.

When a user falls on the pad system, the user contacts the pad system apex 67. The pad system apex 67 supports the user resiliently to push the user away from the trampoline frame horizontal portion 30. The lower end of the buttress pad 61 and the lower end of the wall pad 62 are preferably connected together by a sheet spring cover 64 or by a padded spring cover 63.

The triangular cross section of the pad system 60 produces a variety of geometric configurations that have definable measurements including an apex angle 71. The apex angle 71 is an angle of the surfaces of the buttress pad 61 and the wall pad 62. The inside angle 72 is the angle between the padded spring cover 63 and the wall pad 62. The outside angle 73 is the angle between the buttress pad 61 and the padded spring cover 63. The wall pad inside surface 74 is the inside surface of the wall pad that faces the trampoline bed 32. The wall pad outside surface 75 is the outside surface of the wall pad that faces the buttress pad 61. The apex angle 71 is taken between the wall pad outside surface 75 and the buttress pad 61 inside surface. The apex angle 71 is preferably acute and preferably less than 60°. The height of the wall pad 62 is longer than the spring 31 when the spring 31 is not in an elongated position but rather is in a neutral resting position.

The wall pad preferably includes a lower extension that forms a pad system spring indent 65 that fits over at least a portion of the spring 31. The pad system spring indent 65 conforms to a profile of the spring 31.

The trampoline pad is formed of a pair of annular flexible foam members. Each of the flexible foam members are attached to each other at a folding junction. The foam members can be encapsulated within a fabric shell. Thus, when a user falls on the pad system and contacts the pad system apex 67, the pad system apex 67 folds over the spring 31 and trampoline horizontal frame tube 30. The folding action resists force because it requires a deformation of the entire pad system. Also, the folding action optionally compresses the inflatable member 69.

A variety of different special visual effects can be accomplished by the different net weaving, such as by having different color nets, or by painting one of the nets with glow-in-the-dark paint. The nets can also have a visually cooperating overlay for enabling overlaid designs.

The inside net 120 can be at a higher level than the outside net 130. The inside net 120 is suspended from an enclosure top support 121. The enclosure top support can be a cord or a line such as a metal flexible member. The inside net 120 preferably has a gap between the outside net 130. The gap is preferably substantial and the user can be retained by the inside net 120 initially, then retained by the outside net 130 so that the pair of nets have a dual stage activation such that they act as a pair of springs for retaining the user within the bounding area.

The enclosure pole 124 has an enclosure pole upper connection 122 where the enclosure pole 124 is connected to the enclosure top support 121. The enclosure pole 124 also has an enclosure pole outside upper net connection 123. The enclosure pole outside upper net connection 123 is where the outside net attaches to the enclosure pole. The attachment can be by a strap, or by hardware connectors. The enclosure pole outside upper net connection 123 is at a lower level than the enclosure pole upper connection 122. The enclosure pole outside upper net connection 123 is distal to the enclosure pole upper connection 122.

The inside net top webbing panel 126 can connect the enclosure top support 121 to the inside net upper connection 128 so that the inside net top webbing panel 126 has a circumferential profile for reinforcing the connection between the inside net upper connection 128 and the enclosure top support 121. The inside net top webbing panel 126 can be a fabric panel that overlies and is parallel to the enclosure top support 121. The inside net top webbing panel 126 is preferably flat and stitched to the inside net 120 near the inside net upper connection 128. The inside net top webbing panel 126 reinforces and distributes stress evenly to prevent tangential rips and tears.

The enclosure pole top webbing panel 127 connects between the enclosure pole 124 and the inside net 120 similarly as a reinforcement fabric panel for distributing stress evenly to prevent rips and tears. The enclosure pole top webbing panel 127 is also triangular arc shaped similar to the inside net top webbing panel 126. The edge of the enclosure pole top webbing panel 126 and the edge of the enclosure pole top webbing panel 127 along the inside net upper connection 128 can overlie with each other and be connected with each other at least along a portion of their length.

The inside net profile 129 can be formed to connect to the outside net to bed connection 135, or the inside net to bed connection 134. In either case, the inside net profile 129 is inwardly curved so that the user meets flexible resistance earlier than if the inside net profile 129 were straight. The outside net 130 is also similarly inwardly curved to have a concave profile. The inside net profile 129 and the outside net profile 130 can also be matched to have a similar concave curve for aesthetic and functional purposes.

The pair of nets with the webbing panels provides a softened and preferably more safe catching of the user. The frame can also be made to be softer and preferably more safe so as to complement the pair of nets. The frame can have a modified frame leg and the modified frame leg can be connected together at a leg junction strap 150. The leg junction strap 150 is preferably manufactured as a punched and bent metal plate that has been formed into a three-dimensional shape from a two dimensional flat shape.

The frame leg 131 is preferably U-shaped to support the bed 132. The spring cover 133 overlies the bad 132. The inside net to bed connection 134 is along the inside periphery of the spring cover 133. The lower leg base 140 is a portion of the frame leg 131 and supports the frame leg 131 on a ground surface such as concrete or dirt. The lower leg base 140 can be formed as a tubular member that is bent upward in the middle and bent downward at the left and right sides of the lower leg base 140. The lower leg base connector 141 is preferably formed as a swaged socket or a socket of a varying diameter so that the lower leg base connector 141 connects to the vertical leg section lowers socket connector 146.

The vertical leg section 143 has a vertical leg section lowers socket connector 146 and a vertical leg section upper socket connector 145. The adjacent horizontal leg section 147 is next to the horizontal leg section 144. A series of horizontal leg sections are formed as arcs that connect together to form a complete circle or other shape. The adjacent horizontal leg section 147 fits into a leg junction strap 150. Similarly, the horizontal leg section 144 also fits into the leg junction strap 150. The adjacent horizontal leg section 147 has a decreased diameter portion that fits into the horizontal leg section 144 partially. The decreased diameter portion of the adjacent horizontal leg section 147 also fits within the leg junction strap 150. The leg frame connection 25 can be formed as a leg junction strap 150. The leg junction strap 150 has an adjacent leg junction strap 170 on opposite ends of the horizontal leg section 144. The horizontal leg section 144 fits into the leg junction strap 150 and the adjacent leg junction strap 170.

The leg junction strap 150 generally has a front panel 151 and a rear panel 152. The front panel 151 and the rear panel 152 form the front half of a tube and a rear half of the tube. A panel gap 153 is formed between the front panel 151 and the rear panel 152. The front panel 151 and the rear panel 152 are opposite ends of a steel metal plate that has been bent and formed to shape. The panel gap 153 can be narrow or wide. When narrow, it can be abutting but not connected, and when wider, it can be 1 or 2 mm for example. The front panel 151 transitions to a front shoulder adapter 154. The front shoulder adapter 154 is a transition shape between the front horizontal tube receiver 155 and the front panel 151. The front panel 151 has a tubular profile in a vertical direction and the front horizontal tube receiver 155 has a tubular profile in a horizontal direction. Similarly, the rear horizontal tube receiver 156, has a horizontal tubular profile that is perpendicular to the vertical tubular profile of the rear panel 152. Similarly, the rear panel 152 transitions to the rear horizontal tube receiver 156 at the rear shoulder adapter 159.

The front horizontal tube receiver 155 and the rear horizontal tube receiver 156 have a top plate 160 between them. The top plate 160 forms a top flat area 157. The shoulder 158 is formed between the inside shoulder width 163 and the outside shoulder width 165. The shoulder 158 faces downward and abuts the upper edge of the vertical leg section upper socket connector 145 of the vertical leg section 143. The upper edge faces generally upward and the shoulder 158 faces generally downward so that they contact each other. The shoulder 158 has a rear shoulder adapter 159 and a front shoulder adapter 154. The pair of shoulder adapters are shaped to define the downwardly facing shoulder 158.

The top plate 160 has a top plate thickness 161. The shoulder 158 has an inside shoulder width 163 and an outside shoulder width 165. The front panel and rear panel both have a leg junction strap connectable opening 171 and a leg junction strap connector screw opening 172. The leg junction strap connector screw opening 172 is below the shoulder by a distance of the screw opening shoulder distance 173. The leg junction strap connector screw opening 172 is above the leg junction strap connector bolt opening 171. The leg junction strap connector screw opening 172 defines a through bolt axis 164 where the bolt is inserted.

The interior of the socket is formed between the front horizontal tube receiver 155 and the rear horizontal tube receiver 156. The pair of tube receivers have a socket inside upper radius 166. The tube receivers also have a socket inside lower radius 167. The horizontal tube receiver socket width 162 is sized to receive the horizontal two members. The horizontal tube receiver socket width 168 is also sized to receive the horizontal tube members. The first horizontal tube member fits into the socket and has a section of decreased dimension that has an outside width that fits inside the horizontal tube receiver socket width. Then the second horizontal tube member which is the adjacent horizontal to member fits into the socket of the first horizontal tube member. Therefore, the interior of the socket forms an outside tubular member that receives a horizontal tubular member which is the middle tubular member, which in turn receives an inside tubular member. Therefore, the socket forms a triple layer connection. No bolt is passed along the horizontal tube receiver socket width 168 so as to allow a flexible connection between the three tubular members.

The invention claimed is:

1. A trampoline comprising:

a. a trampoline frame having legs, wherein the trampoline frame has a trampoline frame horizontal portion;

b. a trampoline bed suspended across the trampoline frame horizontal portion;

c. springs extending between the trampoline frame and trampoline bed;

d. an enclosure connected to the trampoline frame, wherein the enclosure has an enclosure upper support, wherein the enclosure supports an enclosure net; and e. a pad system covering the springs and at least partially the trampoline frame horizontal portion, wherein the enclosure net is double layered with an outside enclosure net parallel to an inside enclosure net, wherein the inside enclosure net is mounted at a higher level than the outside enclosure net such that the inside enclosure net has an inside enclosure net upper edge that is at a higher level than an outside enclosure net upper edge.

2. The trampoline of claim 1, wherein the outside enclosure net and the inside enclosure net have a different weave structure.

3. The trampoline of claim 1, wherein an inside net top webbing panel connects the enclosure upper support to an inside net upper connection.

4. The trampoline of claim 1, wherein the outside enclosure net has larger net openings than the inside enclosure net.

5. The trampoline of claim 1, wherein the inside enclosure net has net openings that are less than 1 cm and the outside enclosure net has net openings that are greater than 1 cm.

6. The trampoline of claim 1, wherein an edge of an enclosure pole top webbing panel and an edge of the enclosure pole top webbing panel along an inside net upper connection are at least partially connected with each other.

7. The trampoline of claim 1, wherein a profile of the inside net enclosure net is formed to connect to an outside net to bed connection.

8. The trampoline of claim 1, wherein a profile of the inside net enclosure net is formed to connect to an inside net to bed connection.

9. A trampoline comprising:

a. a trampoline frame having legs, wherein the trampoline frame has a trampoline frame horizontal portion, wherein the trampoline frame horizontal portion comprises horizontal leg sections;

b. a trampoline bed suspended across the trampoline frame horizontal portion;

c. springs extending between the trampoline frame and trampoline bed;

d. an enclosure connected to the trampoline frame, wherein the enclosure has an enclosure upper support, wherein the enclosure supports an enclosure net having an inside enclosure net and an outside enclosure net;

e. a pad system covering the springs; and f. a leg junction strap having a pair of sockets that receive a first horizontal leg section and a second horizontal leg section, wherein the second horizontal leg section is adjacent to the first horizontal leg section so that the second horizontal leg section is an adjacent horizontal leg section, wherein the leg junction strap has a front panel and a rear panel, wherein the front panel and the rear panel form a front half of a tube and a rear half of a tube, wherein a panel gap is formed between the front panel and the rear panel, wherein the inside enclosure net is mounted at a higher level than the outside enclosure net such that the inside enclosure net has an inside enclosure net upper edge that is at a higher level than an outside enclosure net upper edge.

10. The trampoline of claim 9, wherein the pair of sockets further includes a front horizontal tube receiver and a rear horizontal tube receiver.

11. The trampoline of claim 9, wherein the leg junction strap has a front horizontal tube receiver and a rear horizontal tube receiver with a top plate between them, wherein the top plate forms a top flat area.

12. The trampoline of claim 9, wherein the leg junction strap has a shoulder formed between an inside shoulder width and an outside shoulder width, wherein the shoulder faces downward and abuts an upper edge of a vertical leg section upper socket connector of a vertical leg section.

13. The trampoline of claim 9, wherein the leg junction strap has an upper edge that faces generally upward and a shoulder that faces generally downward so that they contact each other, wherein the shoulder has a rear shoulder adapter and a front shoulder adapter, wherein the rear shoulder adapter and the front shoulder adapter are shaped to define the downwardly facing shoulder.

14. A trampoline comprising:

a. a trampoline frame having legs, wherein the trampoline frame has a trampoline frame horizontal portion;

b. a trampoline bed suspended across the trampoline frame horizontal portion;

c. springs extending between the trampoline frame and trampoline bed;

d. an enclosure connected to the trampoline frame, wherein the enclosure has an enclosure upper support, wherein the enclosure supports an enclosure net; and e. a pad system covering the springs and at least partially the trampoline frame horizontal portion, wherein the enclosure net is double layered with an outside enclosure net parallel to an inside enclosure net, wherein the outside enclosure net has larger net openings than net openings of the inside enclosure net.

* * * * *